US008981287B2

(12) United States Patent
Giles et al.

(10) Patent No.: US 8,981,287 B2
(45) Date of Patent: Mar. 17, 2015

(54) ION ANALYSIS APPARATUS AND METHOD

(75) Inventors: Roger Giles, Holmfirth (GB); Matthew Clive Gill, West Didsbury (GB)

(73) Assignee: Shimadzu Corporation, Kyoto (JP)

( * ) Notice: Subject to any disclaimer, the term of this patent is extended or adjusted under 35 U.S.C. 154(b) by 0 days.

(21) Appl. No.: 14/005,654

(22) PCT Filed: Mar. 16, 2012

(86) PCT No.: PCT/GB2012/000248

§ 371 (c)(1),
(2), (4) Date: Nov. 25, 2013

(87) PCT Pub. No.: WO2012/127184

PCT Pub. Date: Sep. 27, 2012

(65) Prior Publication Data

US 2014/0070087 A1 Mar. 13, 2014

(30) Foreign Application Priority Data

Mar. 18, 2011 (GB) ..... 1104665.3

(51) Int. Cl.
*H01J 49/40* (2006.01)
*H01J 49/06* (2006.01)

(52) U.S. Cl.
CPC ..... *H01J 49/40* (2013.01); *H01J 49/062* (2013.01); *H01J 49/401* (2013.01); *H01J 49/403* (2013.01)
USPC ..... 250/282; 250/281; 250/283; 250/287; 250/288; 250/289; 250/290; 250/291; 250/292

(58) Field of Classification Search
USPC ..... 250/281–283, 287–292
See application file for complete search history.

(56) References Cited

U.S. PATENT DOCUMENTS 5,763,878 A * 6/1998 Franzen ..... 250/292
6,111,250 A 8/2000 Thomson et al.
6,670,606 B2 12/2003 Verentchikov et al.
7,034,292 B1 4/2006 Whitehouse et al.

(Continued)

FOREIGN PATENT DOCUMENTS

CA 2349416 A1 11/2002
EP 1367632 A2 12/2003

(Continued)

OTHER PUBLICATIONS

Wiley & McClaren, "Time-of-Flight Mass Spectrometer with Improved Resolution", Rev. Sci. Instrum. 26, 1150-1157, (1955).

(Continued)

*Primary Examiner* — David Porta
*Assistant Examiner* — Meenakshi Sahu
(74) *Attorney, Agent, or Firm* — Sughrue Mion, PLLC

(57) ABSTRACT

The present invention is concerned with an ion analysis apparatus comprising an ion guide having an ion optical axis extending from an ion inlet to an ion outlet, the ion guide being configured to guide ions from the ion inlet to the ion outlet along the ion optical axis, wherein the ion guide comprises at least one extraction region located between the ion inlet and the ion outlet, the at least one extraction region being configured to extract ions moving along the ion optical axis of the ion guide in an extraction direction, the extraction direction being substantially orthogonal to the ion optical axis of the ion guide, wherein the apparatus includes ion radial confinement means that in use confine the ions in the radial direction within the ion guide.

20 Claims, 6 Drawing Sheets

(56) References Cited

U.S. PATENT DOCUMENTS

| | | | | |
|---|---|---|---|---|
| 7,189,967 | B1 | 3/2007 | Whitehouse et al. | |
| 7,858,926 | B1 | 12/2010 | Whitehouse et al. | |
| 2003/0136905 | A1* | 7/2003 | Franzen et al. | 250/292 |
| 2007/0057174 | A1 | 3/2007 | Hansen | |
| 2008/0142700 | A1 | 6/2008 | Dahl et al. | |
| 2009/0045334 | A1 | 2/2009 | Ding | |
| 2010/0065737 | A1* | 3/2010 | Bateman et al. | 250/283 |
| 2010/0072362 | A1 | 3/2010 | Giles et al. | |
| 2010/0301210 | A1* | 12/2010 | Bertsch et al. | 250/290 |
| 2010/0327157 | A1 | 12/2010 | Green et al. | |

FOREIGN PATENT DOCUMENTS

| | | | |
|---|---|---|---|
| GB | 2391697 | A | 2/2004 |
| GB | 2421845 | A | 7/2006 |
| GB | 2427067 | A | 12/2006 |
| GB | 2464592 | A | 4/2010 |

OTHER PUBLICATIONS

Boyle et al. "Time-of-Flight Mass Spectrometry with an Electrospray Ion Beam", C.M. Anal. Chem, 64:2084-2089, (1992).

F. Herfurth et al. "A Linear Radiofrequency Ion Trap for Accumulation, Bunching, and Emittance Improvement of Radioactive Ion Beams", Nucl. Instrum. Meth., A469:254-275, (2001).

International Search Report and Written Opinion dated Oct. 15, 2012 for International Patent Application No. PCT/GB2012/000248 filed on Mar. 16, 2012.

* cited by examiner

ION ANALYSIS APPARATUS AND METHOD

TECHNICAL FIELD OF THE INVENTION

The present invention relates to ion analysis apparatus for the analysis and/or processing of ions, in particular in the context of mass spectrometers.

BACKGROUND OF THE INVENTION

Mass analysis of ions selected from a group of ions can be achieved by extracting the desired ions from an ion beam. In particular, it is known to selectively extract ions from an ion beam by delivering ions to a linear ion storage device and trapping some portion of the ions in an ion trap. Trapping of the ions permits cooling of the ions and an ion cloud is formed in the ion trap. Ions are then extracted from the ion trap and subsequently pass into a mass analyser. WO2008/071923 describes such an arrangement in which a linear ion trap (LIT) comprising a plurality of segments is configured to filter, trap and extract ions. Each segment of the LIT has four rods of hyperbolic profile, arranged to provide a quadrupole field in the space between the rods. A schematic of this instrument 2 is shown in FIG. 1.

In one arrangement ions are introduced into the LIT in the form of a continuous beam and may be transported directly to and trapped within the extraction segment 6. The ions are then cooled in the presence of a buffer gas, before extraction in an orthogonal direction, via ion focusing elements 7 towards a Time of Flight (ToF) analyser 8 comprising detector 9. The application of a digital waveform for the radial trapping of the ions in the LIT assists in the control of the extraction of the ion cloud such that the extracted ions have the correct properties for acceptance by the ToF analyser 8. As is discussed in more detail in WO2008/071923, the LIT segments that precede the ion trap/extraction trap can be configured to provide a mass filter 10 and an isolation trap 12. Ions not extracted can be detected by detector 13.

In this approach to preparing ions for extraction the ions, or "cloud" of ions, are trapped within a fixed region of space. Indeed, WO2008/071923 describes ion trapping by a combination of high frequency signal with periodic time dependence, i.e. an applied RF signal to provide the radial confinement and a static field to provide the axial confinement. In this arrangement the ion cloud has an approximately cylindrical shape. The length of the cylindrical ion cloud is determined by the length of the segment in which the ions are trapped and the voltages applied to adjacent segments. An experimentally measured image of the ion cloud, after its extraction in an orthogonal direction, is shown in FIG. 2. It can be understood that the length of the extracted cloud determines the number of ions that can be trapped at one time.

The present inventors have noted that the total number of ions that can be stored is much greater than the number that can be stored without the onset of the effects which adversely influence the performance of the analyser. The main adverse effect is "space charge" interaction, which results in mass shift or loss of mass spectral resolving power. The space charge interaction is due to columbic repulsion between ions. Such adverse effects may occur not only within the ion trap, but also during ion flight towards and within the ToF analyser.

An alternative to the cylindrical ion cloud approach of WO2008/071923 is a Paul trap (3D ion trap) wherein the ion cloud is compressed approximately towards a single point. In such an arrangement, the ion density is correspondingly higher than the ion cloud formed in the LIT of WO2008/071923, which means that the ion trapping capacity is correspondingly lower, typically by 20 to 100 times.

Further methods to trap ions in the target segment of a LIT are described in F. Herfurth, Nucl. Instrum. Meth. A469 (2001) 254-275. This paper describes "a linear radiofrequency ion trap for accumulation, bunching, and emittance improvement of radioactive ion beams". In this case the ions are initially collected over an axially extended region, spanning a plurality of segments of an LIT, before ions are finally collected into the target segment. This method allows for reduction in the buffer gas pressure without compromising the trapping efficiency, but collection and cooling times are relatively slow.

A still further method of trapping ions prior to ejection for mass analysis, referred to as "dynamic trapping", was first introduced in EP1051734A1 (Shimadzu Research Laboratory) and is also described within patent application U.S. Pat. No. 6,670,606 (Perspective Biosystem, Inc.). In this method the ion traps are used for ion storage prior to ejection for ToF analysis. Such methods allow for trapping without the requirement for a buffer gas. Thus, in this method of 'dynamic trapping' ions are pulsed into the target trapping region from an external storage region, and the trapping is provided by the timed introduction of either RF or DC trapping fields. There are two drawbacks with this method, the first is that the trapping efficiency is strongly mass dependent so that the mass range may be limited. The second drawback is that a significant amount of energy is introduced into the ions, and at the low operating pressure a significant time, several tens of milli-seconds, is required for the trapped ions to lose this Kinetic energy. This means that the scan rate and ion throughput of a LIT-ToF instrument employing this method is severely compromised.

All these prior art methods of trapping ions are applicable to a LIT which is to be used for an ions source of a time of flight analyser. Despite the various trapping options available, the upper scan rate in all cases is limited by the time to cool the ions prior to extraction.

As regards arrangements in which trapping does not occur, poor duty cycle remains a problem. Thus, in a so-called Orthogonal-ToF (O-ToF) arrangement ions are extracted from a field free region external to the ion guide, this is the most common method of introducing ions to ToF analysers. The Orthogonal extraction method was the first method to adapt an ion beam from a continuous ion source into a pulsed ion beam necessary for a time of flight analyser: sections of the beam are pulsed in a direction orthogonal to the continuous beam. This method is commonly known as an "orthogonal Time of flight mass spectrometer" (O-ToF) and it is based on the original work of Wiley & McLaren in 1955 ("Time-of-Flight Mass Spectrometer with Improved Resolution", Rev. Sci. Instrum. 26, 1150-1157 (1955)). There have been a number of methods for focusing ions into the pulsing region to improve resolving power, for example Boyle et al., in C. M. Anal. Chem. 1992, 64, 2084. The duty cycle is much lower than in the Trap-ToF methods discussed above due to the duty cycle at which the continuous beam may be converted to the pulsed beam. Additionally, a proportion of ions are lost by deliberate cutting/reduction of the ion beam to achieve a desired initial velocity and spatial distribution. Using such methods Orthogonal ToF systems have in recent years achieved mass resolving power of 35 to 40 k. O-ToF is usually coupled to a reflectron. A further disadvantage of Orthogonal-ToF systems is the limitation imposed by the flight time of ions from the ion guide region to pulsing region. The low duty cycle, results in a reduction in sensitivity of the mass analyser.

There have recently been a number of attempts to address the problem of the poor duty cycle of the O-ToF, see for example GB2391697 and CA 2349416 (A1), however the efficiency is still not as high as can be achieved by Trap-ToF methods discussed above.

SUMMARY OF THE INVENTION

The present invention seeks to address some or all of the drawbacks discussed above. In particular, embodiments of the present invention seek to provide efficient extraction of ions from an ion guide to a mass analyser in a direction orthogonal to the axis of the ion guide.

Furthermore, embodiments seek to increase the ion throughput and increase the tolerance to space charge.

Embodiments provide means to deliver ions into a ToF analyser with higher duty cycle and high scan rate as compared to prior art approaches.

At its most general, a first proposal is that ions can be extracted from an ion guide without the intermediate step of trapping the ions. That is, the ions can proceed along an ion optical axis of an ion guide and be deflected from their motion along the axis by an extraction field, for example to propel the ions towards a mass analyser. And that ions can be subjected to radial confinement/compression prior to extraction, and applied within the extraction region.

In a first aspect the present invention provides an ion analysis apparatus comprising an ion guide having an ion optical axis extending from an ion inlet to an ion outlet, the ion guide being configured to guide ions from the ion inlet to the ion outlet along the ion optical axis, wherein the ion guide comprises an extraction region located between the ion inlet and the ion outlet, the extraction region being configured to extract ions moving along the ion optical axis of the ion guide in an extraction direction, the extraction direction being substantially orthogonal to the ion optical axis of the ion guide, wherein the apparatus includes ion radial confinement means that in use confine the ions in the radial direction within the ion guide, said ion radial confinement means comprising first ion radial confinement means associated with a portion of the ion guide located before the extraction region and a second ion radial confinement means associated with the at least one extraction region, and wherein the extraction region is switchable between an extraction mode and a transmission mode.

Thus, in use, ions are extracted as they move along the ion optical axis. In practice, an extraction field deflects the desired ions from their procession along the ion optical axis. Indeed, in embodiments, the ions retain some small amount of motion in the original axial direction even after they have been extracted. The present inventors have found that this technique provides efficient extraction of ions and that, surprisingly, there is no need to trap and cool the ions prior to extraction.

Indeed, experimental measurements have shown that the resolving power is not compromised compared to the prior art approach of trapping and cooling.

Thus, embodiments of the apparatus do not include an ion trap, i.e. are not configured to trap ions.

In some embodiments, the ions are in the form of an ion beam, suitably a continuous (i.e. unbroken) ion beam.

An advantage of this approach is that considerably higher scan speeds can be achieved. That is, the number of extracted ion pulses, e.g. as delivered to a ToF analyser, per second can be higher as compared to a trapping and cooling method. This is because there is no need for the time-consuming intermediate step of trapping and cooling of the ions.

The upper scan rate of this new approach to ion extraction is determined by the time taken for ions to refill the extraction region. This refill time can be controlled, for example by adjusting the drift velocity of the ions along the ion optical axis.

Experimental measurements have shown that a scan rate of as high as 1 kHz to 5 kHz can be achieved, which is considerably higher than a typical upper scan rate of about 100 Hz for a trapping/cooling extraction technique. An advantage of such a higher scan rate is that more single spectra can be averaged to a single reported spectrum (i.e. a spectrum observed by the operator/user).

Higher scan rates and the resulting possibility of a greater number of spectra being used for averaging means that the dynamic range can be considerably enhanced, for example increased by 10 to 100 times as compared to a "slower" trapping/cooling technique.

Furthermore, the effective tolerance to space charge (which as discussed above is a problem in trapping/cooling arrangements) can be improved, for example by as much as 100 times.

In practical terms, the apparatus is able to analyse more ions per second than the known trapping/cooling technique.

Whilst very high scan rates are achievable, it is also possible to have lower scan rates, meaning that embodiments of the present invention can provide useful flexibility in their range of operation. For example, scan rates in the range 100 Hz to 5 kHz are preferred, with 200 Hz to 2 kHz more preferred and 500 Hz to 1 kHz especially preferred.

Preferably the ion guide is a linear ion guide and the ion optical axis is the longitudinal axis of the linear ion guide. In this connection, the present invention requires an ion guide, rather than an ion trap as used in the prior art discussed herein.

Suitably the apparatus includes ion axial guide means that in use cause the ions to move along the ion optical axis. Suitably the ion guiding means include voltage supply means for generating an electrical field in the ion guide. Suitably the voltage supply means generates in use an axial potential gradient from the ion inlet to the ion outlet of the ion guide. The potential gradient urges the ions along the ion guide in the desired direction. Preferably the voltage supply means comprises a DC voltage supply means for generating an axial DC potential gradient. An example of a DC potential gradient is illustrated in FIG. 4*a*.

A suitable value for the potential gradient is in the range ≤500 meV/mm, preferably ≤100 meV/mm, more preferably ≤50 meV/mm, more preferably ≤25 meV/mm, and in some embodiments ≤12 meV/mm.

An advantage of embodiments of the present invention is that a range of potential gradients can be used, for example to accommodate different pressures in the ion guide (for example, a higher pressure can accommodate a higher axial potential gradient). Furthermore, different potential gradients can be selected in order to control the "refill" rate of the extraction region. Preferably the ion axial guide means comprises a first ion axial guide means (e.g. first voltage supply means) associated with the portion of the ion guide located before ("upstream") the extraction region (i.e. a non-extraction region), and a second ion axial guide means (e.g. second voltage supply means) associated with the extraction region. In other words, it is preferred to have separate/independent ion axial guide means for the extraction region.

For example, DC1 supply means are associated with a portion of the ion guide located before the extraction region, and DC2 supply means are associated with the extraction region. This permits independent control of ion transmission in/through the extraction region. This has been found to be particularly advantageous because it permits the extraction region to be switched between an extraction mode (e.g. having an extraction field to extract the ions from the extraction region) and a transmission mode (e.g. having non-extraction or transmission field similar to or the same as other parts of the ion guide so that ions can move through the extraction region along the ion optical axis). In particular, this arrangement permits ion extraction to be switched "on" (i.e. an extraction field is generated) whilst other portions of the ion guide continue to operate as normal (i.e. moving the ions along the ion optical axis). Thus, pulsed extraction of ions can be achieved.

The apparatus includes ion radial confinement means that in use confine the ions in the radial direction within the ion guide. Thus, embodiments described herein are distinguished from conventional Orthogonal-ToF methods described above in that unlike conventional O-ToF where the extraction region is field free, a radial confinement means is used to radially compress the ion cloud within the extraction region prior to extraction therefrom.

Typically the ion radial confinement means include waveform supply means for supplying a radial potential field to the ion guide. The waveform is suitably an RF waveform.

In the same way as for the ion axial guide means, it is preferred that there is independent control of the operation of the extraction region such that other parts of the ion guide can continue to operate normally even when extraction is occurring from the extraction region. Preferably the ion radial confinement means comprises a first ion radial confinement means (e.g. a first waveform supply means) associated with the portion of the ion guide located before ("upstream") the extraction region (i.e. a non-extraction region), and a second ion radial confinement means (e.g. a second waveform supply means) associated with the extraction region. In other words, it is preferred to have separate/independent ion radial confinement means (e.g. RF waveform supply means) for the extraction region.

For example, RF1 supply means are associated with a portion of the ion guide located before the extraction region, and RF2 supply means are associated with the extraction region. This permits independent control of ion radial confinement in the extraction region. This has been found to be particularly advantageous because it permits the extraction region to be switched between an extraction mode (e.g. having an extraction field to extract the ions from the extraction region) and a transmission mode (e.g. having non-extraction or transmission field similar to or the same as other parts of the ion guide so that ions can move through the extraction region along the ion optical axis). In particular, this arrangement permits ion extraction to be switched "on" (i.e. an extraction field is generated) whilst other portions of the ion guide continue to operate as normal (i.e. confining the ions in a radial direction). As noted above, this permits pulsed extraction of ions and selective extraction of ions of interest.

Preferably the apparatus includes (a) first and second ion axial guide means associated with non-extraction and extraction regions, respectively, and/or (b) first and second ion radial confinement means associated with non-extraction and extraction regions, respectively, so that the extraction region can operate independently of other parts of the ion guide. This can assist in the rapid refilling of the extraction region.

As alluded to above, it is preferred that the extraction region in use switches between an extraction mode in which ions are extracted from the extraction region, and a transmission mode in which ions are not extracted and instead are transmitted i.e. move through the extraction region along the ion optical axis.

In embodiments, the apparatus includes control means for controlling the ion axial guide means and/or ion radial confinement means. Suitably the control means is configured to control switching of the extraction region as described above.

Suitably the ion guide comprises two or more electrodes (poles or rods) which define an interior space through which the ions move during their transit along the ion guide. A multipole is preferred, especially a quadrupole.

Suitably one or more of the electrodes is a segmented electrode. Indeed, references herein to a segmented ion guide are suitably a reference to an ion guide having segmented electrodes (e.g. a segmented quadrupole). In embodiments only some of the electrodes of the ion guide are segmented (e.g. only one set of electrodes, for example auxiliary electrodes as described below). In other embodiments all of the electrodes of the ion guide are segmented.

The present inventors have found that particularly good results can be achieved when the ion guide is a segmented ion guide and so a segmented ion guide is preferred. That is, suitably the ion guide includes at least 2, preferably at least 3, segments. In particularly preferred embodiments there are at least 4, more preferably at least 5 and most preferably at least 10 segments.

Generally, where the ion guide comprises two or more segments, the extraction region comprises the second or a subsequent segment. In particular, it is preferred that at least a first segment of the ion guide is a guide segment for guiding the ions along the ion optical axis, and a second (or subsequent) segment is or forms part of the extraction region. Optionally, there is at least one guide segment after the extraction region.

More generally, the ion guide suitably includes a first portion being a guide region in which ions are moved along the ion optical axis, typically as a continuous ion beam e.g. by the action of an axial potential gradient as described herein or as ion packets e.g. by the action of a varying DC profile as described herein; and a second portion containing or being the extraction region.

Typically the ion guide includes a third portion, after the second portion, which is another guide region. For example, the third portion can be used to guide ions that have not been extracted to a detector. Alternatively or additionally ions that have not been extracted can undergo further processing.

Typically, the extraction region comprises one of the segments. As noted above, it is preferred to have separate/independent ion axial guide means and/or ion radial confinement means in respect of the extraction region. Conveniently, this can be achieved by providing the segment of the extraction region with the said separate/independent ion axial guide means and/or ion radial confinement means.

Preferably, in embodiments where the ion guide is segmented, the ion axial guide means (e.g. voltage supply means) are configured to generate a varying potential field along the ion guide axis. Indeed, it is preferred that the ions are guided by generating a potential well associated with one or more segments and moving that potential well so that it becomes associated with a different segment, suitably an adjacent segment, suitably in the "downstream" direction of the ion guide, i.e. in the direction of the desired ion motion. Thus, suitably the ion axial guide means provides a potential field that is varied so as to urge ions along the segmented ion guide. In embodiments, the ion axial guide means is a DC voltage supply means that produces the desired varying potential field by applying a varying DC profile to the segmented electrodes.

Suitably the apparatus includes segmented electrode control means for controlling the application of the varying potential field to the segmented electrode.

In some embodiments the ion guide includes ion packeting means to generate packets of ions (referred to herein as ion packets) in the ion guide. Thus, for example, a continuous ion beam entering the ion inlet is "packeted" by the ion packeting means so as to produce a series of ion packets moving along the ion optical axis.

The ion packeting means suitably comprises a segmented electrode. The present inventors have found that by applying a suitable voltage (preferably a DC voltage) to the segmented electrodes, packeting (also referred to herein as "bunching") of ions can be achieved, whilst also urging the ions through the ion guide. Indeed, the embodiment described above wherein a potential well is generated and moved along the segments is one way of forming ion packets.

Indeed, more generally, the ion guide suitably comprises a first set of electrodes configured to radially confine along the ion optical axis, and a second set of electrodes (also referred to herein as "auxiliary electrodes"), which second set of electrodes are segmented electrodes and are preferably configured to guide the ions along the ion optical axis (e.g. as ion packets). Thus, suitably the first and second (auxiliary) sets of electrodes have different functions. For example, preferably they are not associated with the same ion axial guide means and/or ion radial confinement means. Suitably the second (auxiliary) set is configured to cause the ions to form ion packets along the ion optical axis. Preferably the first set comprises continuous electrodes (i.e. non-segmented electrodes). Thus, suitably the ion guide comprises a first set of continuous electrodes and a second (auxiliary) set of segmented electrodes. Typically, the electrodes of the second set of electrodes are located in between, e.g. interchelate with, the electrodes of the first set of electrodes. However, other arrangements are possible. Generally, the electrodes of the second set of electrodes are smaller than the electrodes of the first set. Typically, a continuous first set of electrodes is associated with ion radial confinement means (e.g. a waveform supply means) to radially confine the ions as described herein; and a segmented second set of electrodes is associated with a ion axial guide means (e.g. voltage supply means) configured to apply a varying DC voltage to the segmented electrodes so as to form ion packets.

The present inventors have found that the provision of two sets of electrodes, especially the combination of continuous and segmented sets, permits efficient bunching or ion packet formation, particularly for smaller ion packets. Indeed, the axial size of the ion packets (i.e. their length in the direction of the ion optical axis) can be controlled independently of the first set of "primary" electrodes by controlling the size of the segments of the second set of "auxiliary" electrodes. In this way, optimum radial confinement can be achieved by the continuous first (primary) set of electrodes and a desired ion packet length can be achieved by appropriately sized segmented second (auxiliary) set of electrodes.

Generally, the length of the segments of the segmented second set of electrodes is less than 40 mm, preferably less than 20 mm, preferably less than 10 mm, more preferably about 5 mm or less, more preferably less than 2.5 mm and most preferably less than 0.5 mm.

Suitably, in embodiments where ion packets are produced (typically via the use of segmented electrodes), the extraction of ions from the extraction region is synchronised with the generation of the ion packets, preferably synchronised with the arrival of ion packets in the extraction region. Thus, in one embodiment, extraction is synchronised with the application of a varying DC voltage profile to the segmented electrodes.

Suitably the apparatus includes synchronisation control means to effect said synchronisation.

Preferably the extraction region (for example comprising a segment of a segmented ion guide) comprises an electrode having an aperture through which ions are extracted from the ion guide. In embodiments where there are two sets of electrodes (primary and auxiliary) the electrode with the aperture is suitably an electrode of the first (primary) set. In such cases the extraction region may comprise one or more, preferably two or more, more preferably three or more, segments of the second (auxiliary) set of electrodes. In this way, the auxiliary electrodes can urge the (preferably packeted/bunched) ions through the extraction region, e.g. past the extraction aperture. An example of this arrangement is shown in FIG. 7.

Suitably the aperture is a slit. Preferably the aperture has a length (in the direction of the ion optical axis) of at least 3 mm, preferably at least 4 mm, and more preferably at least 5 mm. A suitable practical range for the aperture size is 1 mm to 20 mm.

In embodiments where the ion guide comprises segmented electrodes, especially embodiments where the ion guide comprises first and second sets of electrodes, suitably the aperture of the extraction region has a length (i.e. in the direction of the ion optical axis) that is substantially the same as or greater than the length of one of the segments of the second set of segmented electrodes.

It is preferred that the aperture length is the same as or less than the length of the first electrode segment of the auxiliary set of segmented electrodes in the extraction region.

In practice it may be the length of the segments of the second set of (segmented) electrodes that are selected to be substantially the same or less than the length of the aperture. However, in some embodiments the length of the segments of the second set of segmented electrodes can be up to twice the length of the aperture. In embodiments a lower limit for the segment length is about 0.5 mm.

In embodiments, the length of each segment of the first set of electrodes is chosen to be between two and eight times the inscribed radius of the ion guide By adopting these preferred limitations, the extraction region can extract substantially all of the ions from an ion packet. This can significantly improve the duty cycle loss.

Typically the electrode of the extraction region is a segment of a segmented ion guide. Suitably the segment/electrode of the extraction region has a length in the direction of the ion optical axis of at least 10 mm, preferably at least 20 mm and more preferably at least 30 mm. In other embodiments, the length is preferably less than 30 mm, more preferably less than 20 mm, more preferably less than 10 mm and most preferably less than about 2 mm.

The present inventors have found that efficient introduction of ions from an ion source into the ion guide and subsequent radial focusing or confinement of the ions can be achieved by providing the ion guide with an inscribed radius ($r_0$) that reduces along the ion guide, for example from a comparatively large value to a comparatively smaller value. Suitably $r_0$ decreases from the ion inlet to the extraction region, suitably from the ion inlet to the ion outlet.

Suitably the ion guide has a first inscribed radius $r_1$ associated with a first region of the ion guide adjacent the ion inlet, and a second inscribed radius $r_2$ associated with a second region of the ion guide, the said second region being spaced along the ion optical axis from the said first region, wherein $r_1 > r_2$.

Preferably the ion guide comprises two or more regions, preferably three or more regions, each having a different $r_0$. Preferably the inscribed radius $r_0$ throughout each region is constant.

In a particularly preferred embodiment the ion guide comprises three regions along the ion optical axis, $r_0$ being constant within each region, wherein the relationship between $r_1$ of the first region, $r_2$ of the second region and $r_3$ of the third region is as follows: $r_1>r_2>r_3$.

The present inventors have found by experimentation that an arrangement in which $r_0$ decreases in this way can provide particularly effective radial focusing of ions in the ion guide. This has the further advantage that by the time the ions get to the extraction region they have a comparatively narrow radial distribution, which assists in achieving control over the form of the ion pulse extracted from the extraction region.

As noted above, this arrangement can permit a comparatively large $r_0$ at the ion inlet, to assist in the introduction of ions to the ion guide. Typical values for $r_0$ at the ion inlet are up to about 20 mm, preferably up to about 10 mm, preferably up to about 8 mm, more preferably up to about 6 mm, more preferably up to about 5 mm.

A particularly preferred range is 3 to 10 mm, more preferably 3 to 8 mm, and most preferably 3 mm to 6 mm. As for values of $r_0$ associated with the extraction region (e.g. just prior to or at the entrance to the extraction region), less than about 3 mm is suitable, with less than about 2 mm being particularly preferred and less than about 1.5 mm being especially preferred. Suitable ranges are 0.5 mm to 3 mm, preferably 0.5 mm to 2 mm, more preferably about 1 mm to 2 mm, and most preferably about 1 mm to about 1.5 mm.

Thus, in embodiments where there are a plurality of regions 1 to n, it is preferred that $r_1$ has a value as discussed above in respect of the ion inlet, and $r_n$ has a value as discussed above in respect of a region associated with the extraction region.

Suitably $r_0$ decreases by a factor of between 1.2 and 2.5 between adjacent regions, preferably by a factor of about 2. Thus, for example, where there are three regions (the first being closest to the ion inlet, the third being furthest away), $r_3=r_2/2=r_1/4$.

The present inventors have found that the waveform applied to the different regions should be controlled so as to maintain substantially uniform stability conditions (e.g. a substantially constant Mathieu parameter, q) for the ions along the ion optical axis. As noted above, the waveform (suitably RF waveform) is typically provided in use by waveform supply means. In embodiments, the waveform supply means is configured to permit independent control of the frequency or voltage or both for each region. Thus, typically, the frequency and/or voltage associated with each region is different. In embodiments the waveform supply means comprises a plurality of waveform generators, each waveform generator being associated with a different region and hence a different $r_0$.

The regions referred to above may comprise one or more segments (e.g. one or more segments of an auxiliary set of electrodes).

In a further refinement, the present inventors have demonstrated that the pressure in the extraction region can be kept low whilst also achieving efficient cooling of the ions. In particular, the present inventors have found that a higher pressure region "upstream" of the extraction region can be provided, which higher pressure region facilitates ion cooling (e.g. by collision with the buffer gas). This in turn permits the pressure "downstream", and in particular in the extraction region, to be comparatively low. Thus, "pre-cooling" of the ions can permit the use of more favourable conditions in the extraction region.

In embodiments, the ion guide has a first pressure region configured to be operated in use at a (buffer) gas pressure of P1, and a second pressure region configured to be operated in use at a (buffer) gas pressure of P2, such that in use the ions pass along the ion optical axis from the first pressure region, through the second pressure region to the extraction region, wherein P1>P2. Preferably P1≥5P2, more preferably P1≥10P2.

Suitably $P1>10^{-2}$ mbar. Suitably $P2<5\times10^{-3}$ mbar, preferably $<1\times10^{-3}$ mbar.

As discussed herein, it is preferred that the ion guide is provided with an axial potential gradient to move the ions along the ion optical axis. The present inventors have found that a comparatively small gradient is desirable when pre-cooling is used. A gradient of ≤50 meV/mm is preferred, more preferably ≤25 meV/mm, more preferably ≤15 meV/mm and most preferably ≤12 meV/mm.

In embodiments, there are three or more pressure regions, the pressure in each region being different. Thus, three regions wherein P1>P2>P3 is an embodiment of the present invention.

More generally, it is preferred that the apparatus includes buffer gas supply means for supplying a buffer gas to the ion guide. That is, it is preferred that the ion guide operates in the presence of a buffer gas.

The ion guide can comprise two or more extraction regions. In an embodiment, it is preferred that the ion guide comprises only one extraction region.

The ion analysis apparatus may comprise additional components including on processing components. For example, the ion analysis apparatus may comprise one or more of an ion trap, a mass filter and ion fragmentation means (e.g. collision cell). Examples of suitable mass filtering means are quadrupole mass filter and a linear ion trap. Examples of suitable ion fragmentation means are collision induced dissociation cell (CID), electron capture dissociation (ECD), photon dissociation cell and electron detachment dissociation cell. These components may be located externally to the ion guide and/or may form part of the ion guide.

In embodiments, an ion filtering means is located before the ion guide.

In embodiments, the ion guide comprises ion fragmentation means.

Indeed, in embodiments a portion of the ion guide is operated as or performs the function of a linear ion trap (LIT).

Suitably the apparatus includes a mass analyser, preferably associated with the extraction region. That is, it is preferred that ions that are extracted from the extraction region are subsequently delivered to the mass analyser.

Preferably the mass analyser is a time of flight (ToF) mass analyser.

Preferably the apparatus is a spectrometer, suitably a mass spectrometer. Preferably the mass spectrometer is a ToF mass spectrometer.

Suitably the apparatus is configured so as to provide a delay between termination of the radial confinement of the ions and application of the extraction pulse. Thus, embodiments include extraction delay means which in use provide a delay between termination of the radial confinement of the ions and application of the extraction pulse.

In this way, a delay may be introduced between the termination of the (digital) confinement waveform and the application of the high voltage dipole pulse. This provides a method to favourably manipulate the phase space of the ion cloud prior to transfer to the ToF analyser. Furthermore, in the case of a quadrupole ion guide, the X and Y poles of at least one extraction region may be switched to intermediate DC voltages during this delay between the termination of the digital trapping waveform and the application of the high voltage dipole pulse. This provides further control of the phase space (emitance) of the ion cloud for favourable ToF performance. It also provides a convenient method to adjust the spatial focusing of the ion beam into the ToF analyser. US2010072362 (A1) provides more guidance as to the application of an extraction delay and is incorporated herein by reference.

In a further aspect the present invention provides an ion analysis apparatus comprising an ion guide having an ion optical axis extending from an ion inlet to an ion outlet, the ion guide being configured to guide ions from the ion inlet to the ion outlet along the ion optical axis, wherein the ion guide comprises an extraction region located between the ion inlet and the ion outlet, the extraction region being configured to extract ions moving along the ion optical axis of the ion guide in an extraction direction, the extraction direction being substantially orthogonal to the ion optical axis of the ion guide.

The optional and preferred features discussed above also apply to this aspect.

In a further aspect, the present invention provides a method corresponding to the apparatus of the above aspects, suitably the first aspect. In particular, the present invention provides a method of extracting ions in an ion analysis apparatus, the said ion analysis apparatus comprising an ion guide having an ion optical axis and an extraction region and wherein ions are moving along the ion optical axis, the method comprising the steps of radially confining the ions within the ion guide and switching the extraction region from a transmission mode to an extraction mode thereby extracting ions from the ions moving along the ion optical axis in an extraction direction substantially orthogonal to the ion optical axis.

Suitably the optional and preferred features associated with the apparatus also apply to the method. That is, for each recited function, means or feature of the apparatus, there is a corresponding method feature or step.

In particular, it is preferred that the method includes the step of producing ion packets, for example by applying a varying DC potential to the ion guide.

The method includes the step of radially confining (focusing) the ions as they move along the ion guide. This can suitably be achieved by applying a RF waveform to the ion guide. Typically this creates a mulitpole field which provides substantially uniform ion stability conditions along the ion optical axis.

In a further aspect, the present invention provides a method of extracting ions in an ion analysis apparatus, the said ion analysis apparatus comprising an ion guide having an ion optical axis and wherein ions are moving along the ion optical axis, the method comprising the step of extracting ions from the ions moving along the ion optical axis in an extraction direction substantially orthogonal to the ion optical axis.

Suitably the optional and preferred features associated with the apparatus also apply to the method. That is, for each recited function, means or feature of the apparatus, there is a corresponding method feature or step.

As discussed herein, the present inventors have found that the generation of ion packets in the context of orthogonal extraction can lead to significant advantages.

In a further aspect, the present invention provides an ion analysis apparatus, the apparatus comprising an ion guide having an ion optical axis extending from an ion inlet to an ion outlet, the ion guide being configured to guide ions along the ion optical axis, wherein the ion guide comprises ion packeting means for producing ion packets along the ion optical axis, and wherein the ion packets are subsequently extracted from the ion guide in an extraction direction, which extraction direction is substantially orthogonal to the ion optical axis.

Suitably the ion packeting means comprises a plurality of packeting electrodes (or segments of an electrode), typically segmented electrodes.

Preferably the ion packeting means includes ion packet voltage supply means for supplying a voltage to the packeting electrodes for producing ion packets.

Suitably the ion guide comprises guide electrodes in addition to the packeting electrodes. Suitably the guide electrodes are associated with a different voltage supply means. Typically the guide electrodes are continuous electrodes. Typically the guide electrodes are associated with ion radial confinement means, for example an RF waveform supply means, for radially confining the ions as they move along the ion optical axis.

The present inventors have also found that significant advantages, as discussed herein, can be achieved by providing an ion guide having two sets of electrodes, a first continuous set for e.g. radial confinement of ions, and a second segmented set for causing bunching or packeting of the ions.

In a related aspect, the present invention provides a method of producing ion packets in an ion guide from ions that are moving along an ion optical axis of the ion guide, the method comprising the steps of forming ion packets from the ions as they move along the ion optical axis, and subsequently extracting one or more of the ion packets from the ion guide in an extraction direction, which extraction direction is substantially orthogonal to the ion optical axis.

Suitably the ions of interest are in an ion beam. In such embodiments, the method is a method of forming ion packets from an ion beam. The method can be regarded as a method of dividing the ions of the ion beam.

In a further aspect the present invention provides an ion analysis apparatus comprising an ion guide having an ion optical axis extending from an ion inlet to an ion outlet, the ion guide being configured to guide ions along the ion optical axis, wherein the ion guide comprises a first set of electrodes, being continuous electrodes, and a second set of electrodes, being segmented electrodes, wherein the apparatus includes ion radial confinement means associated with the first set of electrodes for radial focusing of the ions in the ion guide, and ion packeting voltage supply means associated with the second set of electrodes for generating a potential field in the ion guide that causes packeting of the ions as they move along the ion optical axis.

Suitably the ion packeting voltage supply means is a DC voltage supply means. Suitably the potential field is a varying potential field.

In a related aspect, the present invention provides a method of producing ion packets in an ion guide from ions that are moving along an ion optical axis of the ion guide, the method including the steps of applying an ion radial confinement voltage to a first set of electrodes so as to generate an ion radial confinement potential field in the ion guide, and applying an ion packeting voltage to a second set of electrodes so as to generate ion packets in the ion guide.

All of the optional and preferred functions and features described herein in respect of apparatus and methods relating to ion packets in the context of the first aspect also apply to these aspects.

As discussed herein, the present inventors have found that significant advantages can be achieved by adapting the geometry of an ion guide so as to provide two or more regions with a change in the inscribed radius of the ion guide in going from one region to an adjacent region. In particular, this has been found to assist in effective radial focusing and also to permit larger ion inlets thereby facilitating the introduction of ions into the ion guide.

In a further aspect, the present invention provides an ion analysis apparatus comprising an ion guide having an ion optical axis extending from an ion inlet to an ion outlet, the ion guide being configured to guide ions from the ion inlet to the ion outlet along the ion optical axis, wherein the ion guide comprises a plurality of regions, the inscribed radius $r_0$ being constant within each region, and wherein the inscribed radius is different for each region such that $r_0$ decreases from a region associated with the ion inlet to an adjacent region along the ion optical axis.

In this way the inscribed radius suitably decreases from the ion inlet towards the ion outlet. Preferably the apparatus includes waveform supply means configured to provide a multipole field to each region such that the ion stability conditions is substantially uniform along the ion optical axis. The waveform supply means may comprise a plurality of waveform generators, each associated with one of the regions. This arrangement permits control of the stability conditions within each region.

Suitably the waveform supply means comprise voltage control means and/or frequency control means. This permits independent control of voltage and/or frequency in each region. Where there are a plurality of waveform generators, each may comprise voltage control means and/or frequency control means.

In an embodiment, the ion guide comprises a first region having an inscribed radius r1, and a second region having an inscribed radius $r_2$, wherein $r_1>r_2$. In a further embodiment, there is a third region having an inscribed radius $r_3$, such that $r_2>r_3$.

Suitable values for $r_0$ in some or all of the regions are as described herein.

Suitably the regions comprise at least one segment of a segmented ion guide. Typically each region comprises a plurality of segments.

Preferably the apparatus, suitably the ion guide, includes an extraction region in which ions are extracted in a direction substantially orthogonal to the ion optical axis.

Suitably the apparatus includes an ion source, the ions from which are delivered to the ion inlet of the ion guide. Suitably the ion source produces an ion beam, which ion beam is received by the ion inlet of the ion guide.

Preferably the apparatus includes buffer gas supply means for supplying a buffer gas to the ion guide. That is, it is preferred that the ion guide operates in the presence of a buffer gas. In a related aspect the present invention provides a method of radially focussing ions in an ion guide, which ions are moving along an ion optical axis of the ion guide, the method comprising the step of passing the ions through a plurality of regions of the ion guide, each region having a different inscribed radius, so as to radially focus the ions.

All of the optional and preferred functions and features described herein in respect of apparatus and methods relating to radial focussing in the context of the first aspect also apply to these aspects.

As discussed herein, the present inventors have found that pre-cooling of ions, i.e. prior to an extraction region, can provide significant advantages.

In a further aspect the present invention provides an ion analysis apparatus comprising an ion guide having a first pressure region configured to be operated at a gas pressure of P1, and a second pressure region configured to be operated in use at a gas pressure of P2; and an extraction region; wherein an ion optical axis extends from the first pressure region to the extraction region, the apparatus being configured to guide ions along the ion optical axis from the first pressure region of the ion guide, through the second pressure region of the ion guide and to the extraction region, and wherein P1>P2, and the extraction region is configured to extract ions in an extraction direction, the extraction direction being substantially orthogonal to the ion optical axis.

Preferably the ion guide comprises an ion inlet and an ion outlet, the extraction region being located between the ion inlet and the ion outlet, and the ion optical axis extends from the ion inlet to the ion outlet, the ion guide being configured to guide ions along the ion optical axis from the ion inlet to the ion outlet, and wherein the extraction region is configured to extract ions moving along the ion optical axis.

In embodiments the extraction region is an ion trap.

As discussed herein, a preferred pressure for P1 is $>1\times10^{-2}$ mbar and a preferred pressure for P2 is $<5\times10^{-3}$ mbar.

In embodiments, the apparatus includes two or more extraction regions.

In embodiments, the ions are trapped in and then released from the first pressure region. For example, this might be achieved by providing an ion trap in the first pressure region.

In a related aspect, the present invention provides a method of extracting ions in an ion analysis apparatus comprising an ion guide having an ion optical axis, the method comprising the steps of guiding ions along the ion optical axis of the ion guide through a first region at a pressure of P1; guiding ions along the ion optical axis of the ion guide through a second pressure region at a pressure of P2; and extracting the ions in an extraction direction substantially orthogonal to the ion optical axis, wherein P1>P2.

Suitably the step of extracting ions includes extracting ions moving along the ion optical axis.

In embodiments, the step of extracting ions includes extracting ions from an ion trap.

Suitably, as described herein, there is an axial potential gradient, e.g. as provided by ion axial guide means, to urge the ions along the ion guide. Suitable values for the gradient are discussed herein.

In embodiments, there are more than two pressure regions, for example 3 or 4 pressure regions.

All of the optional and preferred functions and features described herein in respect of apparatus and methods relating to pre-cooling in the context of the first aspect also apply to these aspects.

In respect of each of the above aspects, the present invention also provides a further related aspect, being an ion guide as defined in each of those aspects. The optional and preferred functions and features associated with the ion guides in the aspects directed to ion analysis apparatus and method also apply to the ion guides of these further related aspects.

References herein to a feature that is "configured" to provide a particular function mean that the stated function is provided in use.

Preferably "substantially orthogonal" as used herein means 85° to 95°, preferably 87° to 93°, more preferably 88° to 92°, and most preferably 89° to about 91°.

BRIEF DESCRIPTION OF THE DRAWINGS

Embodiments of the invention and information illustrating the advantages and/or implementation of the invention are described below, by way of example only, with respect to the accompanying drawings in which.

DETAILED DESCRIPTION OF EMBODIMENTS AND EXPERIMENTS

Discussion of Prior Art Trapping Mode

Figure 1:
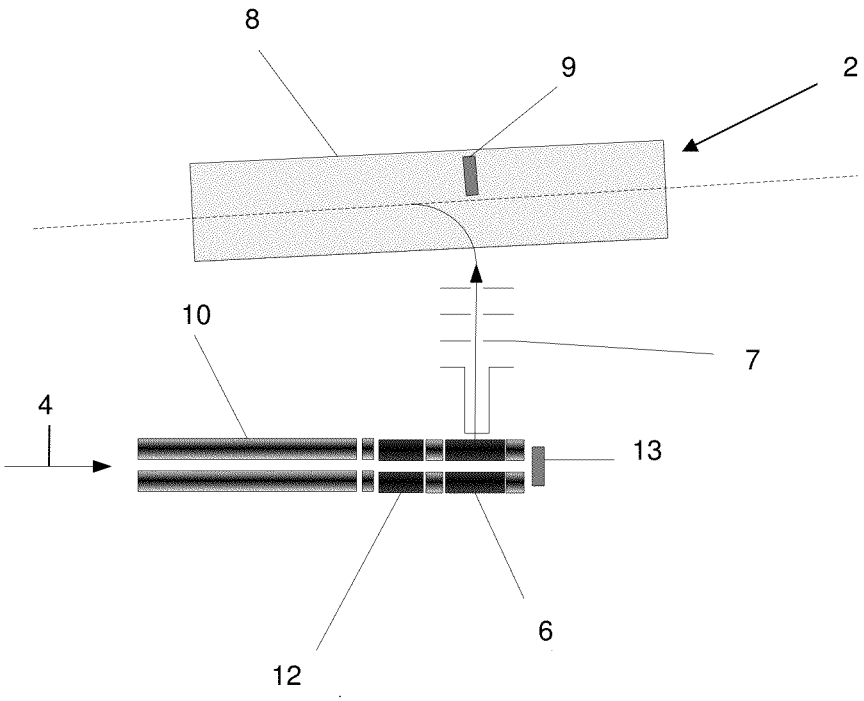
FIG. 1 shows an ion analysis apparatus of the prior art having a linear ion trap (LIT) which ions enter before being trapped and then extracted orthogonally into a ToF analyser.
Figure 2:
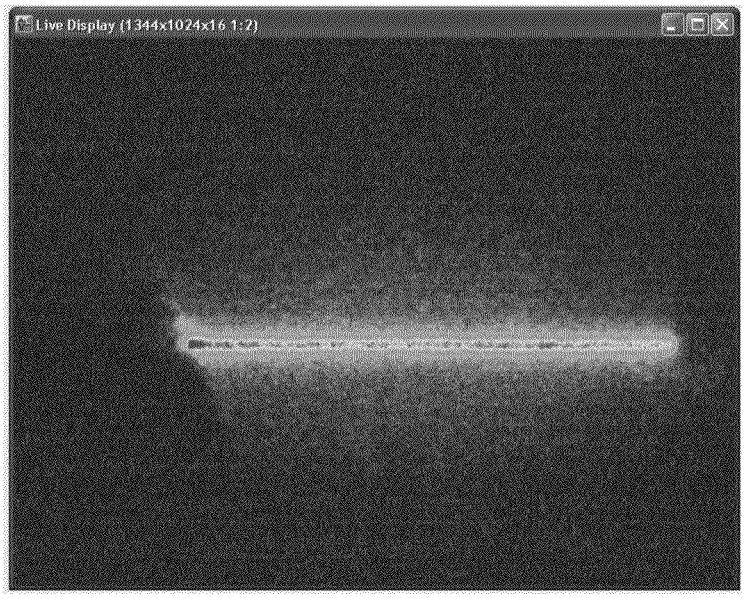
FIG. 2 shows an experimentally measured image of the ion beam extracted from an LIT of the sort shown in FIG. 1.
Figure 3:
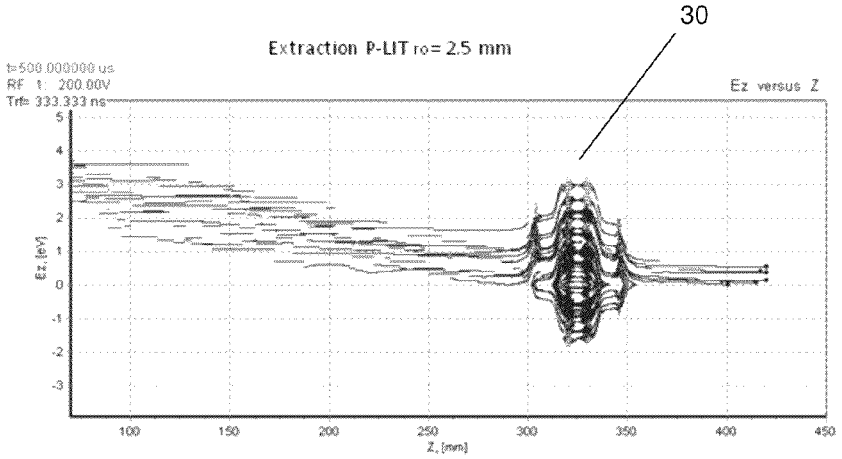
FIG. 3 is a phase space plot showing the DC potential along the length of an LIT of the sort shown in FIG. 1.

The prior art arrangement of WO2008/071923 has already been discussed and is shown in FIG. 1. The Digital Linear Ion Trap (DLIT)-ToF is operated in a "trapping mode". That is, ions from an incoming continuous ion beam are trapped or accumulated within a single segment of the segmented LIT. For completeness, it is noted that there are several means by which ions may be trapped in a single segment of a segmented linear ion storage device. The ion trap of the LIT is filled with a buffer gas at sufficient pressure to trap ions as they pass through the single segment. This method is illustrated by FIG. 3, being a phase space plot. In the example shown, a DC potential gradient is applied along the length of the LIT, apart from the target segment which is held at a lower potential as compared to the adjacent segments. With reference to FIG. 3, the ions are travelling from the left and move to the right, starting with greatest kinetic and potential energy. It can be seen as the ions pass into the target segment 30, they become trapped within its DC potential well. Ions then become cool by further collisions with the buffer gas and in doing so undergo orbits in phase space of decreasing magnitude, until they reach a thermal equilibrium with the buffer gas. The ions are therefore trapped (i.e. confined radially and axially). In a subsequent step, the ions are extracted from the trap for ToF analysis.

Orthogonal Extraction from the Ion Optical Axis (O-ToF Mode)

The inventors have discovered that a Digital Linear Ion Trap-ToF (LIT-ToF) may be adapted so as to operate in a mode which does not require the trapping of ions, which mode is hereafter referred to as "O-ToF mode". In "O-ToF mode" a low DC gradient, typically of 20 meV/mm, in the axial direction is established along the length of a LIT. In this arrangement the linear ion storage device operates as a linear ion guide, which may be segmented. The ion guide receives ions in the form of a continuous ion beam along its longitudinal axis and the ions move along the length of the linear ion guide in a continuous flow to the linear ion guide's extraction region. In this mode, those ions passing through the extraction region are extracted in the orthogonal direction.

The applied radial confinement (RF) and extraction voltages may be the same as those described above in respect of WO2008/071923 (which is incorporated herein by reference). It has been found by means of experimental measurement that the resolving power in this mode is comparable to the prior art trapping and cooling method. This new mode of operation has the advantage therefore that there is no cooling step and therefore it offers the possibility of operating at considerably higher scan speeds. It is preferable but not essential that the extraction region is formed within a separate segment of the linear ion guide which also has a separate radial confinement (RF) waveform supply means. This means that the radial confinement voltage can remain in all other segments at the time ions are extracted from the extraction region. In this way, ions remain in the ion guide "ready and available" to re-fill the extraction region. Indeed, the fundamental limit of this new method for the upper scan rate is determined by the time taken for ions to re-fill the extraction region. This re-fill time depends on the drift velocity in the axial direction and the axial length of the extraction region or segment. Experiments have shown that this re-filling time permits an upper scan limit of 1 to 5 kHz. This compares to the typical upper scan rate in the prior art trap ToF mode of ~100 Hz. Operating at higher scan rate confers the advantage that more single spectra can be averaged to a single reported spectrum (that is observed or viewed by the user).

Figures 4A, 4B:
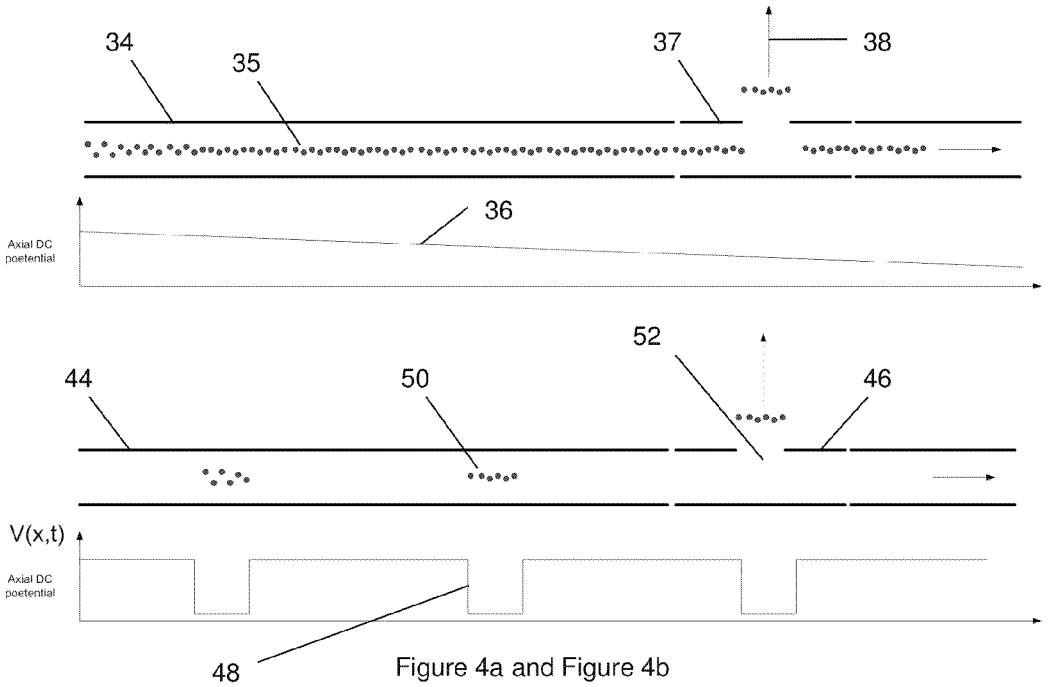
FIG. 4*a* is a schematic of an embodiment of the present invention, wherein an axial DC potential is applied to a linear ion guide to guide a continuous stream of ions, the linear ion guide comprising a segment defining an extraction region from which the ions are orthogonally extracted from the ion guide.
FIG. 4*b* is a schematic of another embodiment of the present invention, wherein the linear ion guide comprises a packeting voltage supply means for dividing the continuous stream of ions into ion packets, which ion packets move along the ion optical axis.

This mode of operation the ions can be maintained "cooled" to the temperature of the buffer gas or close to the temperature of the buffer gas in the ion guides, in respect to their radial motion, whilst maintaining a drift velocity in the axial direction along the ion guide. The axial velocity of the ions is defined by establishing a DC gradient along the length of the linear ion guide and the pressure within it. This mode of operation is illustrated in FIG. 4*a*, which shows ion guide 34 and a continuous ion beam 35 processing along the ion optical axis, urged by an axial potential gradient 36. When ions pass into the extraction region 37 (being a separate segment of the ion guide) they are deflected from the ion optical axis and extracted orthogonally 38, towards a ToF analyser.

Experimentation has shown that embodiments of this new mode of operation provide significant advantages with respect to the prior art, in particular with reference to an improvement in dynamic range, effective tolerance to space charge, and an increase in the maximum ion throughput.

By way of illustration of an extraction delay, i.e. the provision of delay extraction means as discussed above, reference is made to FIG. 10. Between time t=0 and t=$T_{delay1}$ ions are radially confined in the extraction segment. At a later time t=$T_{delay1}$, the ion radial confinement means is terminated: the voltage on the X rods of the ion guide means is set to zero and the voltages on the Y rods is set to an intermediate voltage. Between time t=Tdelay1 and t=Tdelay2 the rods are maintained at these voltage such that the extraction region may be switched to an intermediate mode between the transmission mode and extraction mode. At t=Tdelay−2 the voltage on the Y rods is set to a different DC voltage; V=Vy-extract. Simultaneously, the extraction voltages −Vx-extract and −Vx-extract are applied to the X electrodes (X1 and X2 rods respectively), which marks the end of the intermediate mode. This causes all ions to be ejected from the extraction segment through the X2 rod. The delay introduce between time t=Tdelay1 and t=Tdelay2 effectively gives rise to a reduced velocity spread of the extracted ions in directions transverse to the longitudinal axis of the ion compared to the case that no delay was applied. In a preferred modes of operation the area occupied by the ion cloud in "velocity-position" phase space is substantially unchanged; although the physical size of the ion cloud may increase because the ion cloud is no longer constrained by the RF field (radially confined), and thus it expands in the constant quadrupole field. Correspondingly, the initial phase space ellipse of the ion cloud transforms from one which is initially upright to one which is stretched and tilted, and the position and the velocity of the ions are correlated.

Intermediate voltages may be applied to the X and Y rods during the delay period to manipulate the ion cloud in the extraction. By manipulating the phase space of the ions prior to extraction in this way may result in an the overall increase in the resolving power of the spectrometer.

Alternatively, different voltages may be applied during the delay period to provide spatial focusing of the extracted ion beam to be provided to the ToF analyser.

Pre-Cooling of Ions

The following example represents a preferred mode of operation of the new O-ToF method and also a new method of trapping per se.

An example of the method is as follows. A segmented ion storage device (e.g. ion guide of the O-ToF method) has a first single segment or group of segments for receiving ions from an ion source, and a second segment within a second group of segments defining an extraction region of the device where ions are extracted in an orthogonal direction towards a ToF analyser. The first segment or group of segments is held at a buffer gas pressure P1 and the said extraction region or second group of segments is held at a relatively lower buffer gas pressure P2 (i.e. P1>P2), and wherein the ions are initially trapped in (or pass through) the first segment and then released (or pass from) from first segment and are transferred to the said second segment, where in accordance with the new trapping method they can become trapped. This method has the advantage that the pressure in an extraction segment (whether that segment is a trapping segment as per prior art methods of WO2008071923 discussed herein, or a non-trapping extraction region of the first aspect of the present invention), P2, can be lowered without compromising the trapping and/or extraction efficiency. In this method it is preferred that the DC axial voltage gradient should be maintained low, so as not to re-introduce energy to the ions. For example less than 200 meV/mm, preferably less than 50 meV/mm, more preferably less than 25 meV/mm, and most preferably less than 12 eV/mm, should be used. If the gradient is too high, ions must lose their energy to the buffer gas and this process takes time. If the ion cloud is not sufficiently cooled when it is extracted orthogonally towards the ToF the resolving power achieved by the ToF analyser may be compromised.

Pocketing/Bunching of Ions

The following example represents a preferred mode of operation of the new O-ToF method and also a new method of bunching per se.

Whilst the new mode of operation has significant advantages, in some embodiments the inventors have observed that there is a duty cycle loss. This may be illustrated by the following example. The length of the extraction region is typically 40 mm, and a slit in the electrode through which ions may be extracted in an orthogonal direction may typically be 5 mm in length. Typically, ions are made to travel along the ion optical axis of the linear ion guide with averaged Kinetic energy of ~0.25 eV, meaning that ions of 500 Da mass will travel through the 40 mm long extraction region in a time of 129 μs, whereas ions of 50 Da mass will travel the 40 mm long extraction region in 40 μs. This means that in order to re-fill the extraction region with the heavier 500 Da ions the lighter 50 Da ions will have travelled $\sqrt{10}\cdot 40$ mm thus the maximum duty cycle of the 50 Da ions is 4% and the maximum duty cycle for the 500 Da is 12.5%.

These duty cycle losses may result in a decrease in the sensitivity and limit of detection of the instrument. The following example of a preferred feature of the new mode of operation and of a new method of operation per se has been found to address this duty cycle loss whilst still maintaining the high scan speed. An embodiment is shows in FIG. 4*b*. In this case a linear ion storage device 44, is operated as a linear ion guide that receives ions in the form of a continuous ion beam along its longitudinal axis, and the ions travel along the length of the linear ion guide. The linear ion guide has at least one segment defined as an extraction region 46 and additionally has ion packeting means (varying axial DC potential) 48 effective to convert the continuous ion beam received by the linear ion guide into bunches or ion packets 50, which propagate in the axial direction, and wherein ion extraction pulses are synchronised to the ion packeting means. The synchronisation can be arranged such that each propagating ion bunch is extracted from said extraction region as it is passes through the extraction region. Most preferably each propagating ion bunch is extracted from the region of the extraction slit 52 of the extraction region 46. Ions passing through the extraction region are extracted in the orthogonal direction.

Figure 5:
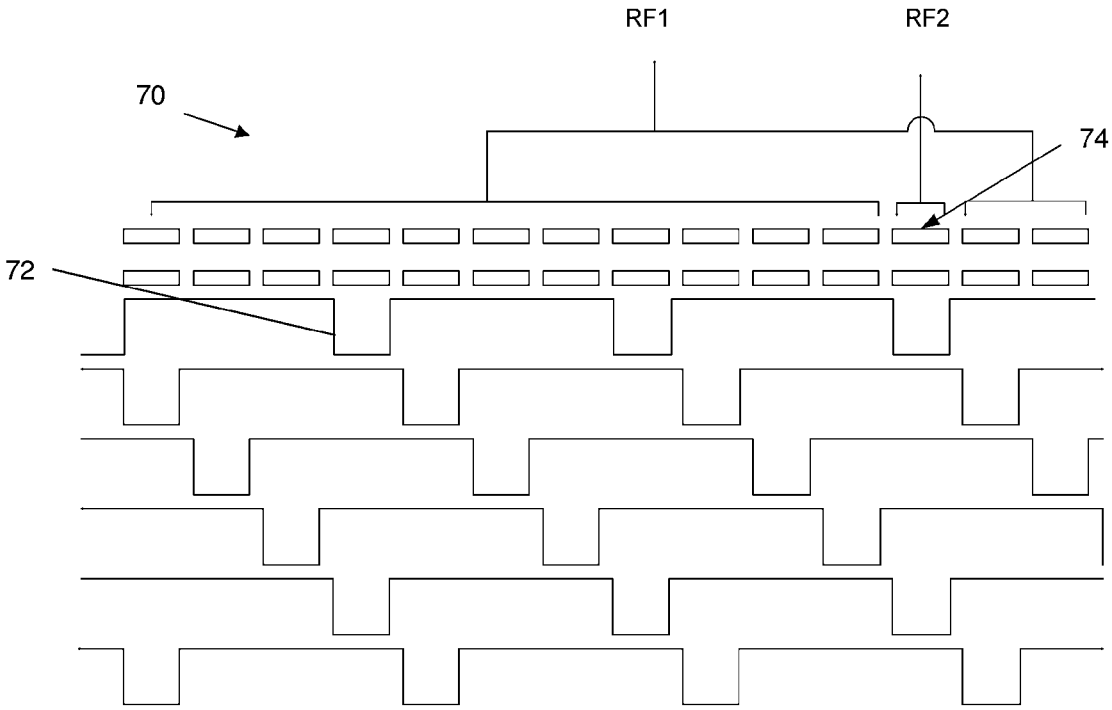
FIG. 5 is a schematic of another embodiment of the present invention, wherein the linear ion guide is segmented and the extraction region has a different RF voltage supply (RF2) to the rest of the linear ion guide (RF1) so that RF2 may be switched off when an extraction voltage is supplied to the extraction region.

There are any number of means described in the prior art to effect the propagation of ions as bunches in the linear ions guide, and these may be employed in the current invention. However, a preferred method is to divide the ion guide, preferably but not essentially a quadrupole ion guide, into separate segments. The length of each segment being chosen to be between two and eight times the inscribed radius of the ion guide (e.g. quadrupole ion guide). In this scheme a DC voltage is applied directly to each segment, by a separate supply (in addition to the RF), and the applied DC profile is varied so that a potential well is propagated down the axis of the segmented ion guide. An example is given in FIG. 5, which shows a segmented ion guide 70. In this case an axial potential well 72 is applied to every 5th segment, and the extraction switch is triggered in every fourth application of the axial profile. In the case of FIG. 5 it is the 1st and 5th, i.e. as the potential well becomes aligned with the extraction region 74. For operating the instrument at a scan rate of 1 KHz, the frequency of the 4 phase DC profile would also be 1 KHz, meaning that the DC level switches at a rate of 4 KHz (in this example), i.e. each DC level is applied for a duration of 200

μs. Note that the extraction region has a separate radial confinement means (RF1) as compared to the "guiding" portion of the ion guide (RF1).

Figure 6:
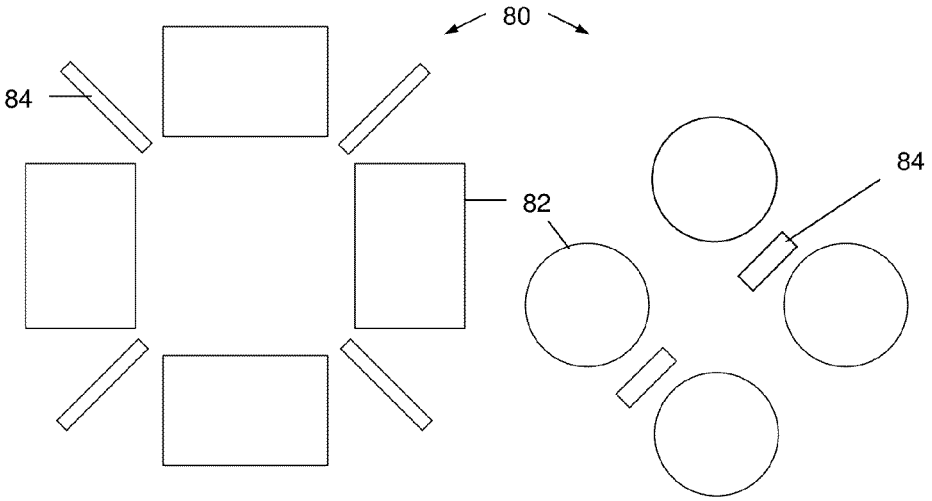
FIG. 6 shows cross-sections of ion guides comprising packeting (auxiliary) electrodes in addition to (primary) guide electrodes.
Figure 7:
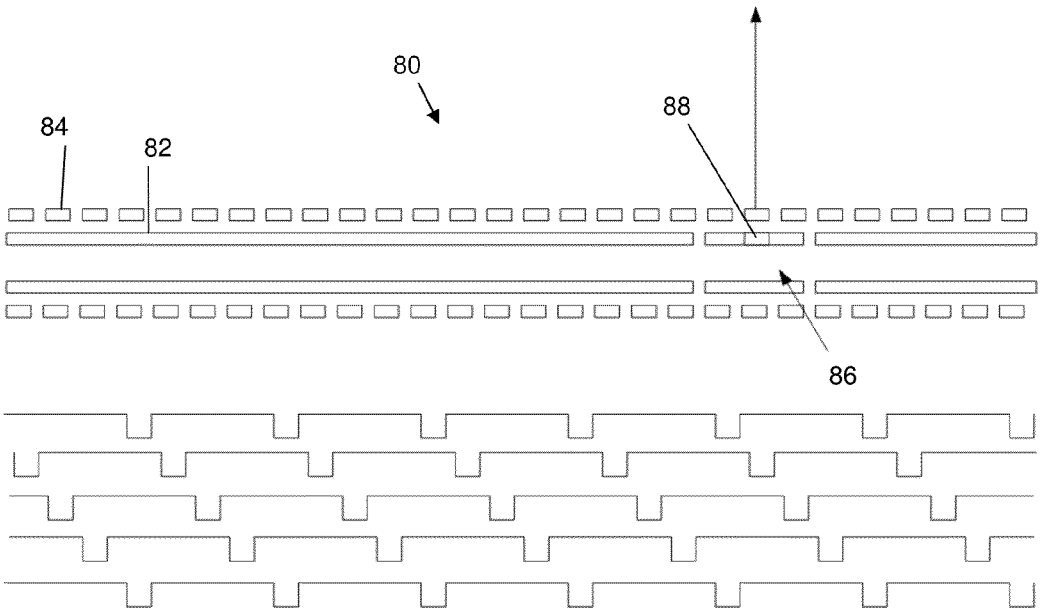
FIG. 7 is a schematic diagram of a yet further embodiment of the present invention, wherein the linear ion guide is formed from continuous guide electrodes, the ion guide comprising a separate segment defining the extraction region and the ion guide further comprising a plurality of segmented packeting electrodes and a voltage supply means for supplying a voltage to the segmented packeting electrodes for producing ion packets.

In other embodiments shown in FIG. 6, a linear ion guide 80 is constructed from continuous rods 82, with the ion packeting means effective to convert a continuous ion beam into ion packets is applied to auxiliary rods 84. These auxiliary elements may be segmented. This embodiment is shown in axial profile in FIG. 7. In this example the segmentation of auxiliary rods 82 can be made finer than in embodiments where segmented electrodes are also required to provide a radial confinement field. It means that the ion bunch can be made shorter than the total length of the extraction region 86 and preferably comparable to or less than the length of the extraction slit 88. This embodiment can therefore not only provide fast scanning but also a 100% duty cycle.

Thus, embodiments provide a linear ion guide, that receives ions in the form of a continuous ion beam along its longitudinal axis, said linear ion guide having at least one segment configured as an extraction region and additionally having a ion packeting means effective to convert the continuous ion beam into bunches propagating in the axial direction. Wherein the ion packeting means is provided by auxiliary electrodes located between or outside the main poles of the linear ion guide and wherein ion extraction pulses are synchronised to the ion packeting means. The auxiliary electrodes have DC voltages to define the axial DC ramp or packeting/bunching function, whereas the poles of the ion guide carry the RF trapping voltage.

Radial Focussing of Ions

The following example illustrates a preferred way of operating the new O-ToF mode and also illustrates a further aspect of the invention which permits efficient introduction of ions.

Figure 8:
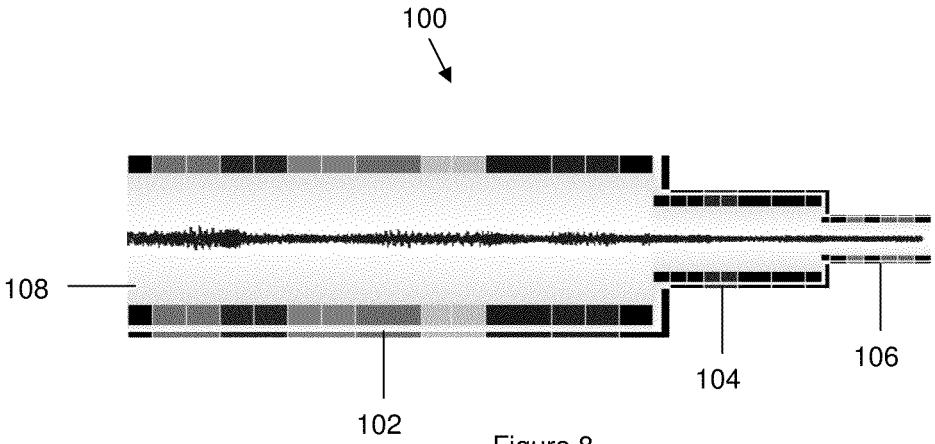
FIG. 8 is a schematic diagram of a yet further embodiment of the present invention, wherein the ion guide is segmented and comprises different regions, each region having a constant inscribed radius ($r_0$), with the inscribed radius ($r_0$) decreasing from one region to the next.
Figure 9:
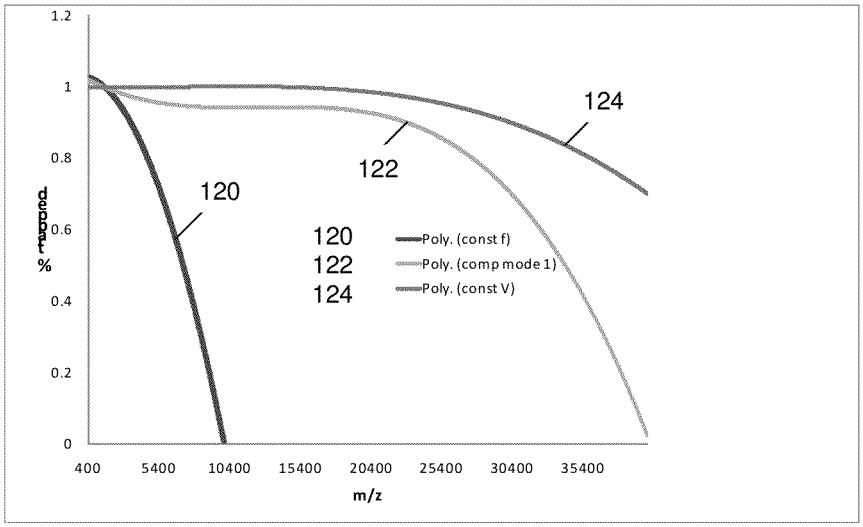
FIG. 9 shows ion transmission plotted as a function of ion mass for three different strategies to applying the guiding RF waveforms to the ion guide.

For efficient introduction of ions from an external ions source, it is advantageous for the inscribed radii of the Linear ion guide to be large (e.g. $r_0$=5 mm) so that ion guide can efficiently trap the incoming ions. However, for efficient extraction at the extraction region the ion guide should have an inscribed radius typically r=1.25 mm. One solution to this problem is illustrated in FIG. 8. This shows an ion guide 100 formed from three groups of segments 102, 104, 106 and an ion entrance end 108. The ion entrance end 108 is associated with the group of segments 102 having the greatest inscribe radius $r_1$. The second group of segments 104 has radius $r_2$ which is smaller than $r_1$. The third group of segments 106 has radius $r_3$ which is smaller than $r_2$. In this example $r_3=r_2/2=r_1/4$. This Figure also shows the typical trajectory of the ions passing through the linear ion guide with decreasing $r_0$. In order to pass ions through the device particularly efficiently, the radially confinement RF waveform can be adjusted with respect to its frequency or voltage or a combination of both, in order to main the Mathieu parameter q constant within all segments or group of segments.

Figure 10:
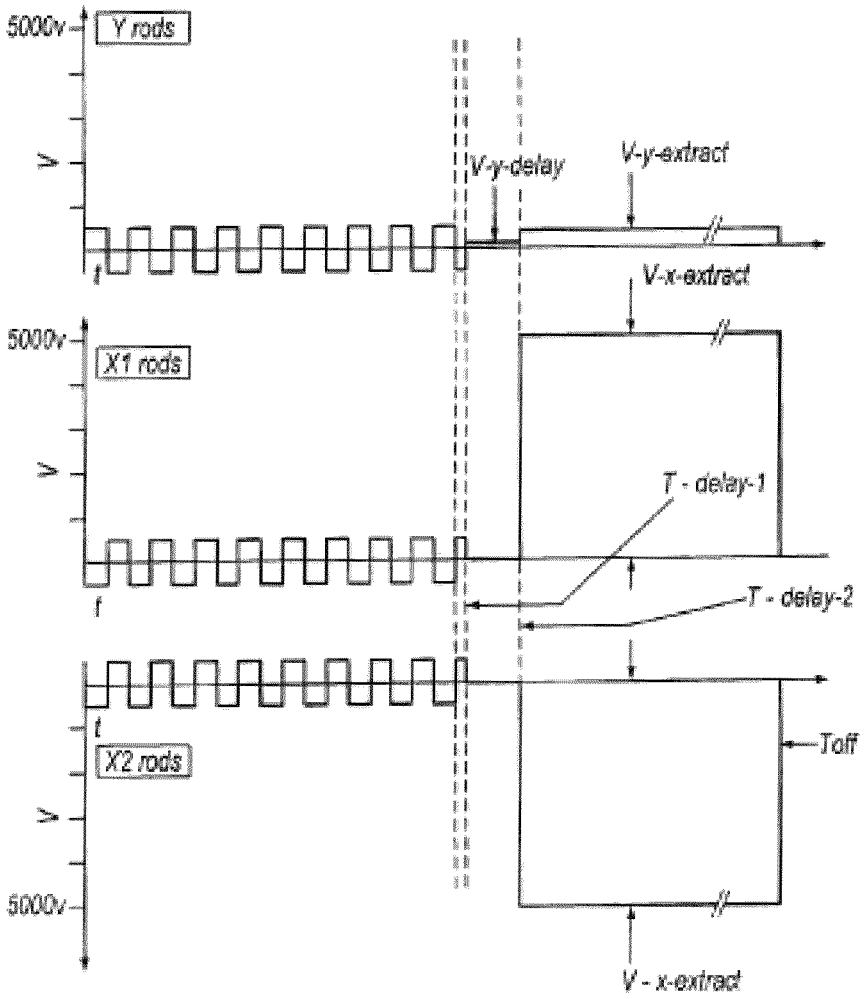
FIG. 10 shows schematically the provision of an extraction delay.

The influence of this waveform matching was investigated by the inventors by means of an ion optical simulation. The results are shown in FIG. 10 where ion transmission is plotted as function of ion mass for three different strategies (120—constant f; 122—composite mode; and 124—constant V) to apply the trapping waveforms. The most optimal strategy is to apply to the same voltage to each group of segments, and adjust the frequency accordingly to compensate for the reduction in the inscribed radius.

The invention claimed is:

1. An ion analysis apparatus comprising an ion guide having an ion optical axis extending from an ion inlet to an ion outlet, the ion guide being configured to guide ions from the ion inlet to the ion outlet along the ion optical axis, wherein the apparatus includes ion axial guide that in use causes the ions to move along the ion optical axis, wherein the ion guide comprises at least one extraction region located between the ion inlet and the ion outlet, the at least one extraction region being configured to extract ions moving along the ion optical axis of the ion guide in an extraction direction, the extraction direction being substantially orthogonal to the ion optical axis of the ion guide, wherein the apparatus includes an ion radial confinement device that in use confines the ions in the radial direction within the ion guide, said ion radial confinement device comprising a first ion radial confinement device associated with a portion of the ion guide located before the extraction region and a second ion radial confinement device associated with the at least one extraction region, and wherein the extraction region is switchable between:

an extraction mode in which the extraction region has an extraction field to extract ions from the extraction region while ions are being moved along the ion optical axis by the ion axial guide in other portions of the km guide; and a transmission mode in which the extraction region has a transmission field to allow ions to move through the extraction region salting the ion optical axis.

2. An ion analysis apparatus according to claim 1, wherein the ion guide is a linear ion guide and the ion optical axis is the longitudinal axis of the linear ion guide.

3. An ion analysis apparatus according to claim 1, wherein said ion axial guide comprises a voltage supply to generate an axial potential gradient from the ion inlet towards the ion outlet.

4. An ion analysis apparatus according to claim 1, wherein the ion radial confinement device comprises a first RF waveform supply device associated with the portion of the ion guide located before the extraction region, and an independently controllable second RF waveform supply associated with the at least one extraction region.

5. An ion analysis apparatus according to claim 1, wherein the ion guide comprises a quadrupole.

6. An ion analysis apparatus according to claim 1, wherein the ion guide is segmented and the at least one extraction region comprises a single segment of the ion guide.

7. An ion analysis apparatus according to claim 1, wherein the apparatus includes an ion packeting device to produce a series of moving ion packets along the ion optical axis.

8. An ion analysis apparatus according to claim 7, wherein the ion guide comprises a first set of electrodes, being continuous electrodes, and an associated ion radial confinement device to radially confine the ions along the ion optical axis, and a second set of electrodes, being segmented electrodes, and an associated ion axial guide to guide the ions along the ion optical axis.

9. An ion analysis apparatus according to claim 8, wherein the ion radial confinement device associated with the first set of electrodes comprises an RF waveform supply, and the ion axial guide associated with the second set of electrodes comprises a varying DC voltage supply.

10. An ion analysis apparatus according to claim 7, wherein the extraction of ions from the extraction region is synchronised with the arrival of ion packets in the extraction region.

11. An ion analysis apparatus according to claim 8, wherein the extraction region comprises an electrode with an aperture through which ions are extracted from the ion guide, and wherein the length of the aperture in the direction of the ion optical axis is substantially the same or greater than the length of a segment of the said second set of electrodes.

12. An ion analysis apparatus according to claim 1 wherein the ion guide has a first inscribed radius $r_1$ associated with a first region of the ion guide adjacent the ion inlet, and a second inscribed radius $r_2$ associated with a second region of the ion guide, the said second region being spaced along the ion optical axis from the said first region, wherein $r_1>r_2$.

13. An ion analysis apparatus according to claim 12, wherein the ion guide comprises three regions along the ion optical axis, $r_0$ being constant within each region, wherein the relationship between $r_1$ of the first region, $r_2$ of the second region and $r_3$ of the third region is as follows: $r_1>r_2>r_3$.

14. An ion analysis apparatus according to claim 1, wherein the ion guide has a first pressure region configured to be operated in use at a buffer gas pressure of P1, and a second pressure region configured to be operated in use at a buffer gas pressure of P2, such that in use the ions pass along the ion optical axis from the first pressure region, through the second pressure region to the extraction region, wherein P1>P2.

15. An ion analysis apparatus according to claim 14, wherein $P1>10^{-2}$ mbar and $P2<10^{-3}$ mbar.

16. An ion analysis apparatus according to claim 1, wherein the apparatus includes a buffer gas supply for supplying a buffer gas to the ion guide.

17. An ion analysis apparatus according to claim 1, wherein the apparatus includes a time of flight mass analyser associated with the extraction region for mass analysis of extracted ions.

18. An ion analysis apparatus according to claim 1, wherein the apparatus is a time of flight mass spectrometer.

19. A method of extracting ions in an ion analysis apparatus, the said ion analysis apparatus comprising an ion guide having an ion optical axis extending from an ion inlet to an ion outlet, the ion guide being configured to guide ions from ion inlet to the ion outlet along the ion optical axis, wherein the apparatus includes ion axial guide that in use causes the ions to move along the ion optical axis, wherein the ion guide comprises at least one extraction region located between the ion inlet and the ion outlet, the at least one extraction region being configured to extract ions moving along the ion optical axis of the ion guide in an extraction direction, the extraction direction being substantially orthogonal to the ion optical axis of the ion guide, wherein the apparatus includes an ion radial confinement device that in use confines the ions in the radial direction within the ion guide, said ion radial confinement device comprising a first ion radial confinement device associated with a portion of the ion guide located before the extraction region and a second ion radial confinement device associated with the at least one extraction region, and wherein the extraction region is switchable between:

an extraction mode in which the extraction region has an extraction field to extract ions from the extraction region while ions are being moved along the ion optical axis by the ion axial guide in other portions of the ion guide; and a transmission mode in which the extraction region has a transmission field to allow ions to move through the extraction region along the ion optical axis, the method comprising the steps of:

using the ion radial confinement device to radially confine ions within the ion guide, and switching the extraction region from the transmission mode to the extraction mode thereby extracting ions from the extraction region in an extraction direction substantially orthogonal to the ion optical axis while ions are being moved along the ion optical axis by the ion guide in other portions of the ion guide.

20. A method according to claim 19, wherein the method includes the step of producing ion packets from the ions moving along the ion optical axis and subsequently extracting at least some of the ion packets.

* * * * *